United States Patent [19]

Chambers

[11] 4,262,373

[45] Apr. 21, 1981

[54] SWIMMING POOL COVER ASSEMBLY

[75] Inventor: Robert R. Chambers, Studio City, Calif.

[73] Assignee: Atlantic Richfield Company, Los Angeles, Calif.

[21] Appl. No.: 34,467

[22] Filed: Apr. 30, 1979

[51] Int. Cl.[3] ..... E04H 3/19; A47H 5/04

[52] U.S. Cl. ..... 4/502; 160/68; 160/342

[58] Field of Search ..... 4/498–503, 4/514, 494–496, 534, 557; 220/216; 160/68–70, 265, 342

[56] References Cited

U.S. PATENT DOCUMENTS

| | | | |
|---|---|---|---|
| 1,749,197 | 3/1930 | Stuart | 160/70 X |
| 2,388,163 | 10/1945 | Laird | 220/216 |
| 3,045,253 | 7/1962 | Price | 4/501 |
| 3,074,079 | 1/1963 | Isaacson | 4/500 |
| 3,074,474 | 1/1963 | Dunn | 160/265 X |
| 3,418,667 | 12/1968 | Powlan | 4/500 |
| 3,613,126 | 10/1971 | Granderath | 4/502 |
| 3,813,704 | 6/1974 | Troiano | 4/501 X |
| 3,889,303 | 6/1975 | Kinzel | 4/501 X |
| 4,137,575 | 2/1979 | Klaffke et al. | 4/498 |
| 4,165,543 | 8/1979 | Reinert | 4/500 |

FOREIGN PATENT DOCUMENTS

| | | | |
|---|---|---|---|
| 496795 | 4/1930 | Fed. Rep. of Germany | 160/69 |
| 2452550 | 5/1976 | Fed. Rep. of Germany | 4/499 |

*Primary Examiner*—Stuart S. Levy

*Attorney, Agent, or Firm*—Wofford, Fails & Zobal

[57] ABSTRACT

An assembly for covering a swimming pool when it is not in use. A roll member is rotatably mounted at one end of the pool for rolling up and unrolling a sheet of material of dimensions for covering the pool. A scissor type extension device moves the outer end of the sheet toward the other side of the pool when unwinding. The scissor device is moved between the retracted and extended positions by a rotating screw. An electrical motor rotates the screw and the roll member. A slide track mechanism submerges the entire assembly when rolled up.

4 Claims, 5 Drawing Figures

SWIMMING POOL COVER ASSEMBLY

BACKGROUND OF THE INVENTION

1. Field of the Invention

This invention relates in general to swimming pools, and more particularly to a pool cover with an automatic opening and covering system.

2. Description of the Prior Art

Covering a swimming pool while not in use has several advantages. It reduces evaporation, retains heat in the water, and keeps the pool clearer. It also may prevent a small child from stumbling into an unattended pool. A disadvantage is that a tough vinyl covering is bulky and fairly difficult to roll out and unroll.

A mechanism for automatically extending and retracting a cover is known. It has tracks mounted on each side of the pool, a roll member for the cover, and an electric motor. The motor pulls ropes that are sewn into the sides of the cover to extend it. Once retracted, the rolled up cover remains at the end wall of the pool, or on the area immediately behind the end of the pool wall. These prior art mechanisms required modifications the length of the pool that detracted from the normal beauty and usefulness of the sides of the pool.

SUMMARY OF THE INVENTION

It is a general object of this invention to provide an improved pool cover assembly for automatically covering and uncovering a pool without requiring extensive modifications along the sides of the pool.

It is a further object of this invention to provide an improved pool cover assembly for automatically covering and uncovering a pool that has an improved device for extending the cover over the pool, yet does not require tracks alongside the pool.

It is the further object of this invention to provide an improved pool cover assembly for automatically covering and uncovering the pool that also submerges the rolled up cover at the end of the pool when retracted.

In accordance with these objects, this invention provides a pool cover assembly comprising:

- accumulation means for accumulating a flexible sheet of material at one end of the pool;
- a flexible sheet of material of dimensions sufficient to cover a substantial part of the pool, having an inner end secured to the accumulation means;
- extension means for moving the outer end of the sheet toward the opposite end of the pool from the accumulation means, the accumulation means being adapted to allow the extension without tangling; and
- submersion means for submerging the accumulation means into the pool for storage and for surfacing for extension.

In accordance with a preferred embodiment of this invention, a pool cover assembly is provided that uses a scissor type extension device. A roll member is mounted to one end of the pool for winding the cover on an off. Rods in pairs are pivotally secured together in a criss-cross pattern and mounted to the pool wall below the roll member. Closing the ends of the rods extends the length, and opening the ends retracts the rods. The free ends of the outer pair of rods are slidably carried by the outer end of the cover. A screw opens and closes the rods as the motor is winding or unwinding to cover and uncover the pool. The motor, roll member and extension device are all mounted to a downwardly extending slide tract; and a winch is mounted at the bottom of the pool for drawing the assembly downwardly to the bottom for storage. The roll member and rods are hollow and sealed at their rends to provide sufficient buoyancy to allow the apparatus to rise to the surface when it is to be extended.

DESCRIPTION OF THE PREFERRED EMBODIMENT

Figure 1:
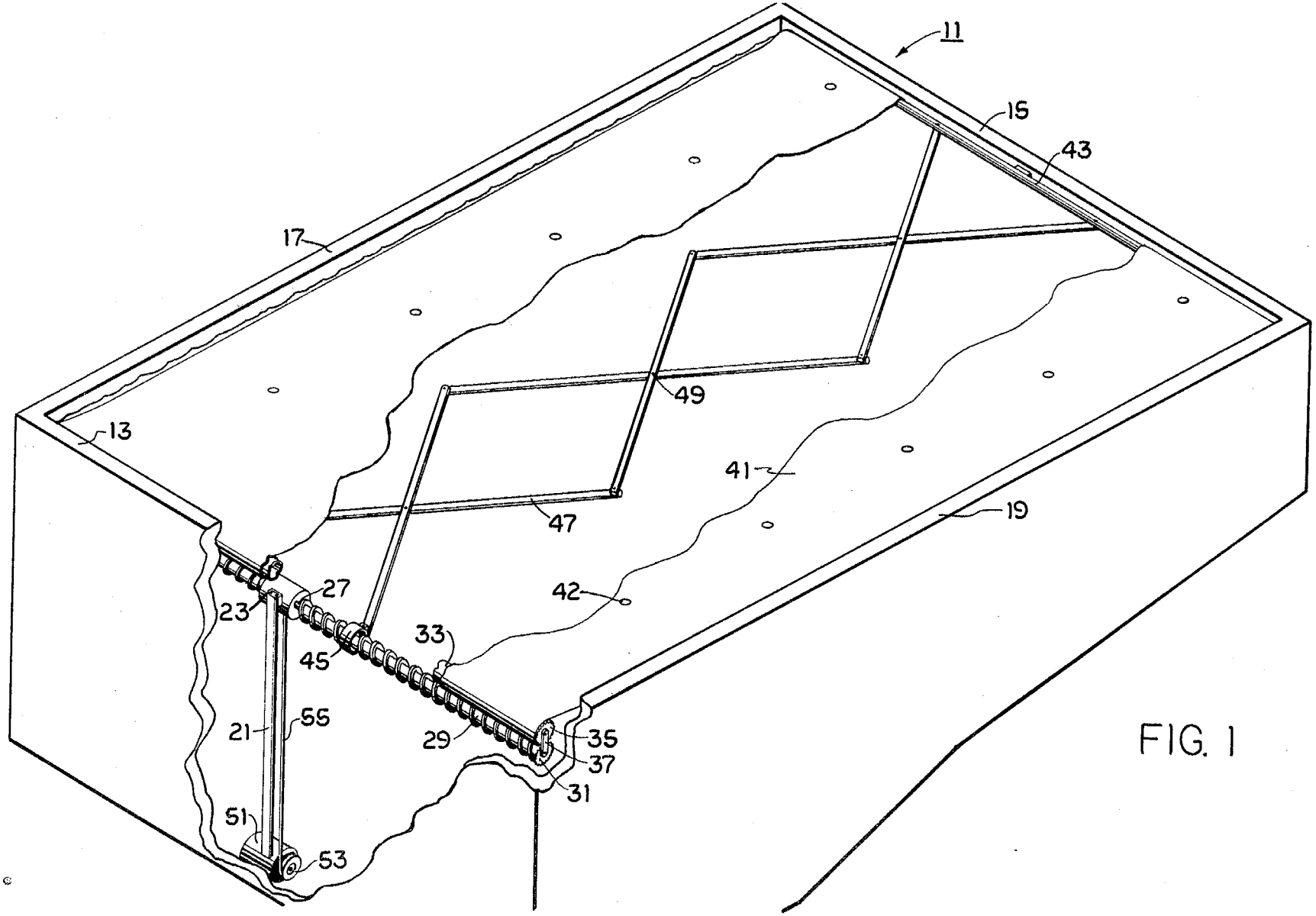
FIG. 1 is a perspective view, partially broken away, of a swimming pool with a cover apparatus in accordance with this invention, with the cover shown in the extended position.
Figure 2:
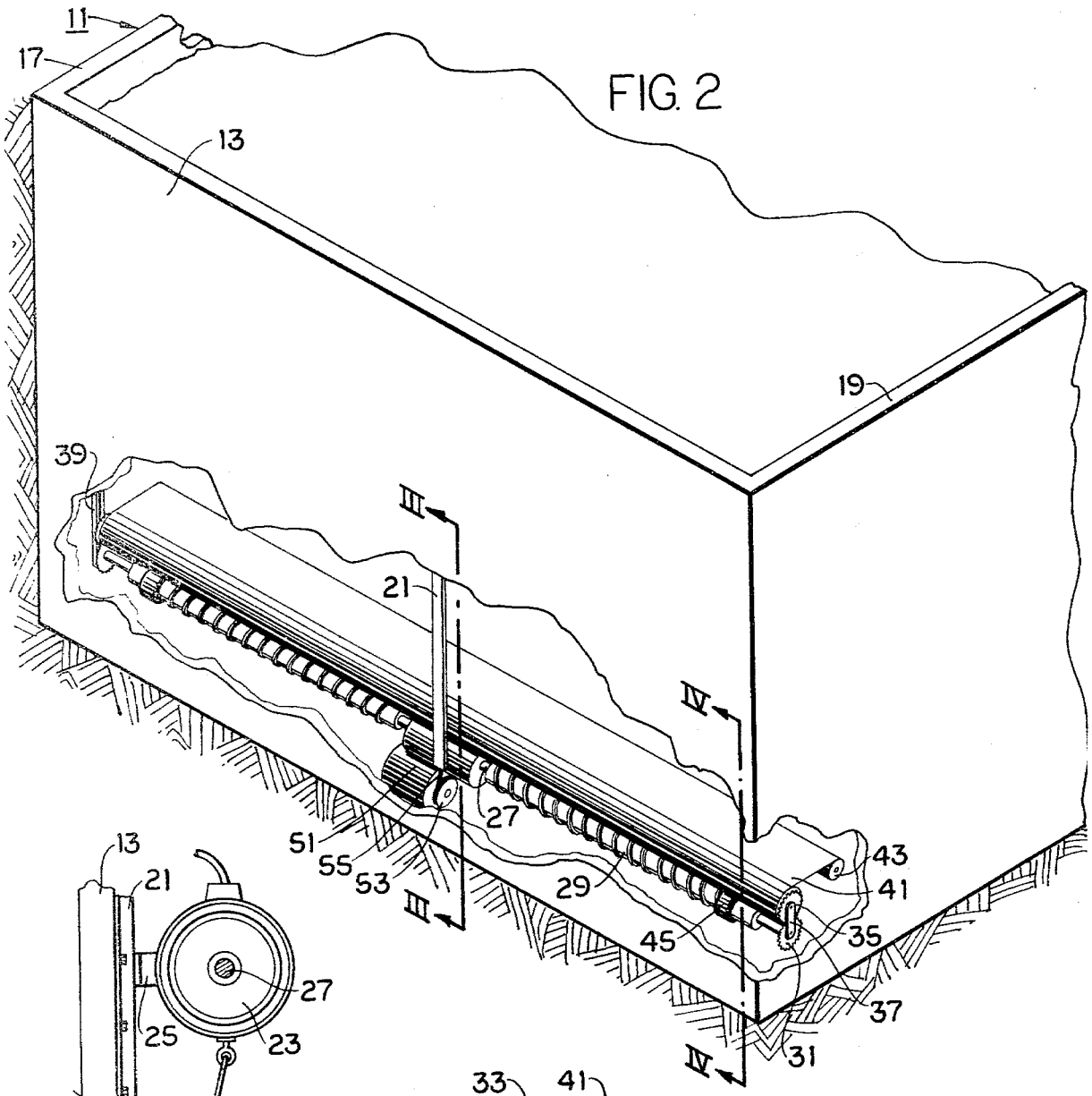
FIG. 2 is a perspective view, partially broken away, of a portion of the swimming pool and cover apparatus of FIG. 1, with the cover shown in the retracted and submerged position.

Referring to FIG. 1, a rectangular swimming pool 11 is shown, having end walls 13 and 15 and side walls 17 and 19. As shown also in FIG. 2, the automatic cover mechanism is mounted to the deepest end wall 13. It includes a slide track 21 that extends vertically from the water level when full, to a point near the bottom. Slide track 21 is mounted to wall 13 and has a slot (not shown) that runs along its length.

Figure 3:
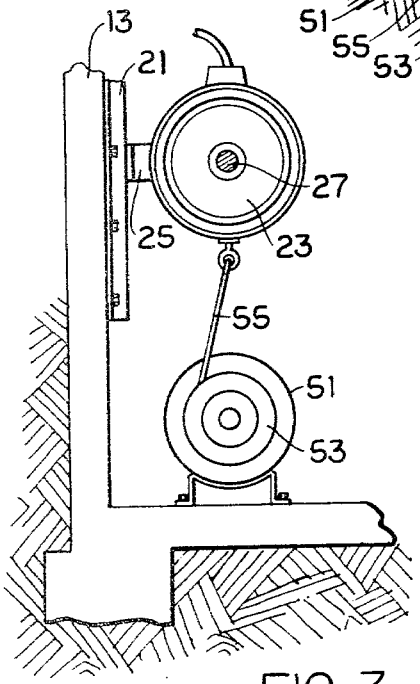
FIG. 3 is a cross-sectional view of the cover apparatus of FIG. 1, taken along the line III—III of FIG. 2.

An electrical motor 23 has a rear bracket 25, FIG. 3, secured to it that slidably fits within the slot on slide track 21. Two output shafts 27 extend from the motor 23, one on each side. The output shafts 27 rotate in unison with each other. A threaded rod or screw 29 extends laterally from each output shaft 27. One of the screws 29 contains clockwise or right hand threads, while the other contains counterclockwise or left hand threads. Screws 29 are positioned in a horizontal plane and parallel with end wall 13. One screw 29 extends from the motor 23 to a point near side wall 17, while the other extends from motor 17 to a point near side wall 19. Screws 29 are of equal length and are coaxial with each other. A gear or sprocket 31 is mounted to the outer end of each screw 29.

A cylindrical roll member 33 (FIG. 1), is mounted above the screws and parallel with them. Roll member 33 is hollow and sealed at its ends. Roll member 33 extends substantially across the pool width and has gears 35 on its ends that rotate with the roll member. Gears 35 mesh with gears 31 and are driven by them. A bracket 37 on each end extends from the screws 29 to the roll member 33 for supporting the roll member. A guide 39 is located on each wall 17 and 19 adjacent the ends of the roll member 33 and screws 29. Brackets 37 slidably engage the guides 39 to stabilize the roll member 33 and screws 29.

A cover or sheet of material 41 of dimensions sufficient to cover the pool is adapted to be rolled onto and off the roll member 33. Sheet 41 is a flexible, tough material, preferably laminated vinyl reinforced with a tightly woven mesh. It is in the shape of the pool, in the illustrated embodiment rectangular, with an inner end secured to the roll member 33. The outer end is adapted to extend to the opposite end wall 15. A stiffener or brace 43 is secured to the outer end and extends substantially from side wall 17 to side wall 19. Drain holes 42 are provided in sheet 41.

An extension means for moving the outer end of the sheet toward the opposite end 15, as the motor 23 unwinds the roll, is secured between screws 29 and brace 43. It is a scissor type device made up of a plurality of rods pivotally interlinked in a criss-cross fashion. As shown in FIG. 1, a thread follower or sleeve 45 is carried on each screw 29. Sleeve 45 has internal threads, thus moves linearly along screw 29 while the screw rotates and the sleeve is restrained from rotation. Since the screws 29 are threaded in reverse to each other and are rotated in the same direction, the sleeves 45 will either linearly approach each other, or move away from each other, depending on the direction of rotation.

The free ends of a first pair of rods 47 are secured by articulated connections to the sleeves 45. A second pair of rods 47 is pivotally secured at one of their ends to the first pair of rods 47. The second pair's other ends are pivotally secured to a third or last pair of rods 47. As many pairs are employed as necessary the length of the pool. The free ends of the last pair of rods 47 are slidably carried by the brace 43. All of the rods 47 are the same length. The rods 47 and the brace 43, preferably, are sealed so as to provide buoyancy. Within each pair, each rod is pivotally mounted to its other pair by a connection at mid center, indicated as 49. Each rod 47 within a pair crosses its other pair so that one end of each rod will be nearer side wall 17 and the other end nearer side wall 19.

Figure 4:
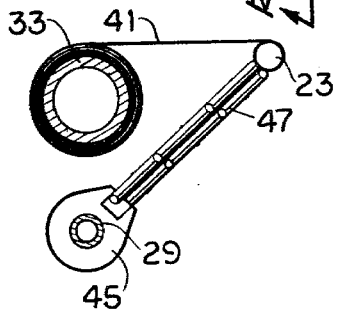
FIG. 4 is a cross-sectional view of the cover apparatus of FIG. 1, taken along the line IV—IV of FIG. 2.
Figure 5:
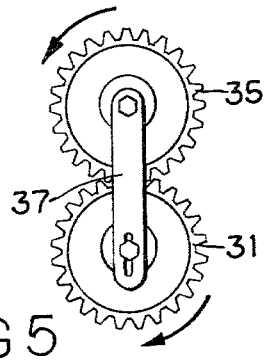
FIG. 5 is an end elevational view of the gear drive for the cover apparatus of FIG. 1.

Moving the sleeves 45 together causes the rods 47 to extend their total length, as shown on FIG. 1. Moving the sleeves 45 apart shortens the total length, as shown in FIG. 4. Screws 29 and motor 23 serves as means to move the free ends apart and toward each other. The pitch of the threads on screws 29, and the size of gears 31 and 35 are correlated so that the sheet will unwind and wind up at the same rate that the extension device moves the brace 43. An overrunning clutch could be utilized to avoid placing the rods 47 in a bind should speeds differ.

The apparatus also includes submersion means for submerging the entire assembly into the pool when retracted. This gets the apparatus out of the way. The submersion apparatus includes the slide track 21 and a winch mounted at the bottom of the pool below the slide track. The winch has an electrical motor and gear reducer 51 which drives a pulley 53. A cable 55 is fastened to the screw motor 23 and is wrapped around pulley 53. Solenoid circuitry (not shown) engages and disengages pulley 53 from its motor 51. The motor 51 friction is sufficient to maintain the assembly in a submerged state when pulley 53 is in engagement.

In operation, to cover the pool, initially the assembly will be restrained at the bottom of the pool by the winch. The solenoid is then actuated to release pulley 53 from winch motor 51. The buoyancy of roll member 33 and rods 47 causes the assembly to rise to the surface. Motor 23 will begin rotating screws 29 and roll member 33 through gears 31 and 35. This rotation in the unwinding direction causes the sheet 41 to unwind from the roll member 33. At the same time, threaded sleeves 45 begin moving toward each other, thus extending the overall length of the extension device and causing brace 43 to move toward the opposite pool end 15. When the sheet is fully extended, the motor 23 stops.

To uncover the pool, motor 23 rotates in the reverse direction, winding sheet 41 back onto roll member 33. Threaded sleeves 45 begin moving apart from each other, thus shortening the length of the extension device. When fully retracted, winch motor 51 is actuated to draw the assembly to a point near the bottom, as shown in FIG. 4.

In the specific embodiment described hereinbefore the roll member has been disclosed to serve as an accumulation means for accumulating the flexible sheet, since it does so with a minimum amount of trapped air. Other accumulation means can be employed if desired. For example, the accumulation means may comprise a progressive gathering of the sheet. The gathering is made easier where the sheet has pre-fold lines to facilitate accordioning into a compact, gathered accumulation. Also, the scissor type extension device has been disclosed to serve as the extension means. Other extension means can be employed. For example, linear metallic members such as bands of arcuate cross section can be unrolled or fluid, such as air or water, can be pumped into inflatable, unrolling channels to extend the outer end of the flexible sheet.

In this area of technology, even a partial covering of the surface of the water in a pool is beneficial. Consequently even a rectangular cover is beneficial in oddly shaped pools. On the other hand, the cover in accordance with this invention can be shaped to afford maximum coverage. For example, the flexible sheet can be in other shapes, such as fan shaped.

While the pool cover assembly of this invention can be stored submerged at any location; such as sides or ends of the pool, the usual least obtrusive submerged storage is adjacent the deep end where diving is usually done and the bottom end of the pool is seldom used by swimmers.

It should be apparent that an invention having significant advantages has been provided. The cover apparatus requires no tracks to be laid. The entire assembly is located inside the pool to avoid any accidental stumbling over it.

Although this invention has been discribed with a certain degree of particularity, it is understood that the present disclosure has been made only by way of example and that numerous changes in the details of construction and the combination and arrangement of parts may be resorted to without departing from the spirit or the scope of this invention.

What is claimed:

1. A pool cover assembly, comprising:

accumulation means for accumulating a flexible sheet of material; said accumulation means being located at one end of the pool and consisting essentially of a roll member;

a rotation means for rotating said roll member for causing said sheet to roll onto said roll member for accumulation and to roll off said roll member for extension; said rotation means being connected with said roll member;

a flexible sheet of material of dimensions sufficient to cover a substantial part of the pool, having an inner end secured to the roll member of the accumulation means;

extension means for moving the outer end of the sheet toward the opposite end of the pool from the accumulation means; said accumulation means being adapted to allow movement of the outer end toward said opposite end of said pool without tangling of said sheet; and submersion means for submerging said accumulation means into the pool adjacent said one end of said pool when the sheet is accumulated for storage, and for positioning the accumulation means at the surface when the sheet is to be extended; the submersion means comprising:

a slide track mounted to the wall of the pool; the slide track extending downwardly adjacent the wall for a selected distance; the roll member being carried by the slide track; and means for drawing the roll member down the slide track after the sheet is rolled up, and for releasing the roll member when the sheet is to be unwound, the roll member being constructed to be sufficiently buoyant to rise to the surface when released.

2. The pool cover assembly according to claim 1 wherein the means for drawing the roll member down the slide track comprises an electrically driven winch mounted adjacent the bottom of the slide track and having a cable extending between it and the motor means.

3. The pool cover assembly according to claim 1 wherein the roll member, rotation means, extension means, and submersion means are located inside the pool, and wherein the width and length of the sheet are slightly less than the width and length of the pool.

4. A pool cover assembly, comprising:

a roll member located at one end of the pool extending substantially across the width of the pool but within the confines of the walls of the pool the roll member having gears secured to each end for rotation therewith;

a flexible sheet of material of dimensions sufficient to cover a substantial part of the pool, having an inner end secured to the roll member; the sheet having an outer end with a brace secured to it parallel with the roll member;

a pair of gears, each mounted on a respective end of the roll member for rotation therewith;

a slide track mounted to the wall of the pool immediately behind the roll member; the slide track extending vertically down the wall for a selected distance and being centered on the pool wall;

a pair of screws coupled to opposite sides of the motor for rotation by the motor in the same direction and same speed, the screws being coaxially aligned and horizontally positioned parallel to the roll member; one screw having right hand threads and the other screw having left hand threads;

a pair of gears, each mounted on a respective outer end of one of the screws for rotation therewith and meshing with the roll member's gears so that rotation of the screws by the motor also rotates the roll member to roll off and roll up the sheet;

a pair of threaded sleeves, one carried by the right handed screw and one by the left handed screw;

a plurality of rods in pairs, each rod within a pair being pivotally secured to its pair intermediate their ends, and each pair being pivotally secured to an adjacent pair at their ends to define a scissor device that moves between a retracted position when the ends of the rods are drawn apart to an extended position when the ends of the rods are drawn toward each other;

each free end of the first pair being mounted to one of the sleeves;

each free end of the last pair being slidably carried by the brace;

an electrically driven winch mounted adjacent the bottom of the slide track and having cables extending between it and the motor for drawing the motor, screws, roll member and sheet to the bottom of the slide track;

the roll member, brace and rods being hollow and sealed to provide sufficient buoyancy to lift the motor, sheet, and screws when the winch is released.

* * * * *